US008561264B2

(12) United States Patent
Hasegawa et al.

(10) Patent No.: US 8,561,264 B2
(45) Date of Patent: Oct. 22, 2013

(54) FEMALE SNAP BUTTON

(75) Inventors: Kenji Hasegawa, Tokyo (JP); Makoto Momose, Tokyo (JP); Hiroyuki Sugiyama, Tokyo (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/576,733

(22) PCT Filed: Feb. 3, 2010

(86) PCT No.: PCT/JP2010/051521

§ 371 (c)(1),
(2), (4) Date: Aug. 2, 2012

(87) PCT Pub. No.: WO2011/096056

PCT Pub. Date: Aug. 11, 2011

(65) Prior Publication Data

US 2012/0297586 A1 Nov. 29, 2012

(51) Int. Cl.
*A44B 1/18* (2006.01)

(52) U.S. Cl.
USPC ..... 24/114.4; 24/114.05; 24/108

(58) Field of Classification Search
None
See application file for complete search history.

(56) References Cited

U.S. PATENT DOCUMENTS

| | | | | |
|---|---|---|---|---|
| 4,430,777 | A | 2/1984 | Takeda | |
| 4,785,508 | A * | 11/1988 | Takeda | 24/114.4 |
| 6,170,129 | B1 | 1/2001 | Pferdehirt | |
| 6,694,573 | B2 * | 2/2004 | Matsushima | 24/114.4 |

FOREIGN PATENT DOCUMENTS

| | | | |
|---|---|---|---|
| AT | 254863 | E | 12/2003 |
| DE | 3239445 | A1 | 10/1983 |
| DE | 19741779 | A | 4/1999 |
| DE | 297024746 | U1 | 7/2003 |
| DE | 297024744 | U1 | 8/2003 |
| DE | 297024747 | U1 | 10/2003 |
| DE | 69913097 | D1 | 1/2004 |
| DE | 69913097 | T2 | 8/2004 |
| EP | 1038460 | A1 | 9/2000 |
| ES | 2210882 | T3 | 7/2004 |
| JP | 132201/1977 | | 10/1977 |
| JP | 58-154618 | | 10/1983 |
| JP | 154618/1983 | | 10/1983 |
| JP | 188208/1987 | | 11/1987 |
| JP | H07-3924 | | 2/1995 |
| JP | 2000-279209 | A | 10/2000 |
| JP | 2003-310310 | A | 11/2003 |

OTHER PUBLICATIONS

International Search Report, PCT International Application No. PCT/JP2010/051521, mailed Apr. 20, 2010.

* cited by examiner

*Primary Examiner* — Jack W. Lavinder
(74) *Attorney, Agent, or Firm* — Kilpatrick, Townsend & Stockton LLP

(57) ABSTRACT

A female snap button detachably receives a projection of a male snap button in a projection-receiving space. The female snap button includes an annular protrusion rising from a base and defining the projection-receiving space. In the annular protrusion, there are formed thick-walled portions with the thickness from the inner surface of the protrusion to the radially outer side being relatively thick and thin-walled portions with the thickness being thinner than that in the thick-walled portions. The thick-walled portions and the thin-walled portions are arranged alternately in the circumferential direction.

6 Claims, 6 Drawing Sheets

FEMALE SNAP BUTTON

This application is a national stage application of PCT/JP2010/051521 which is incorporated herein by reference.

BACKGROUND OF THE INVENTION

The present invention relates to a female snap button, and especially to a female snap button made of synthetic resin.

A snap button, which is widely used for parts to be put together of clothing etc., consists of a male snap button (male snap) as fixed to one of the clothing parts and a female snap button (female snap) fixed to the other. The male and female snaps are connected and disconnected with each other by mating and demating a projection of the male snap with and from a projection-receiving space of the female snap. A female snap made of synthetic resin can obtain flexibility (elasticity) more easily than a metal snap for mating and demating the projection with and from the projection-receiving space. A female snap as injection-molded of thermoplastic resin is disclosed in e.g. Japanese Examined Utility Model Application Publication No. H07-3924, and comprises generally a disk-like base and a cylindrical, annular protrusion rising from the base defining a projection-receiving space on the base. At a distal end of the inner peripheral surface of the annular protrusion, there is formed an inner bulge bulging radially inward. On the other hand, at a distal end of the projection of the male snap button, there is formed an outer bulge bulging radially outward. When the projection of the male snap is put in and taken out from the projection-receiving space of the female snap, the outer bulge of the projection first overlaps the inner bulge of the annular protrusion, which elastically displaces the annular protrusion radially outward. Then, the outer bulge of the projection passes the inner bulge of the annular protrusion, and thereupon the annular protrusion is radially restored. Thereby, connecting or disconnecting the male snap with the female snap is completed. In the state with the male and female snaps connected, the outer bulge of the projection catches on the inner bulge of the annular protrusion, which prevents the projection from being easily removed from the projection-receiving space of the female snap.

In a conventional synthetic-resin female snap, the inner and outer peripheral surfaces of the annular protrusion are in a horizontally perfect circle shape with a constant radial thickness of the annular protrusion in the whole circumferential direction. Therefore, when the projection of a male snap is put in and taken out from the projection-receiving space of the female snap, the flexibility of the annular protrusion as being elastically deformed radially outward is uniform in the whole circumferential direction. For this reason, very high precision is required for the flexibility of the annular protrusion, so it is not easy to produce female snaps. Further, to enhance a resistance in the projection-receiving space to detachment from the projection, there is a problem that a force required to mate and demate the projection with and from the projection-receiving space will be increased. In addition, because of faulty molding or long-term use, there would be nonuniformity in the detachment resistance or the mating and demating force in the circumferential direction such that the projection would be easily removed from the projection-receiving space at a certain point in the circumferential direction.

[Patent document 1] Japanese Examined Utility Model Application Publication No. H07-3924

An object of the invention as made in view of problems as mentioned above is to provide a female snap button which does not require high precision in terms of the flexibility of the annular protrusion, can reduce a force to mate and demate the projection with and from the projection-receiving space while maintaining a relatively high resistance in the projection-receiving space to detachment from the projection, and it is unlikely to bring about nonuniformity in the detachment resistance or the mating and demating force in the circumferential direction.

SUMMARY OF THE INVENTION

To solve the problems, according to the present invention, there is provided a female snap button made of synthetic resin which detachably receives a projection of a male snap button in a projection-receiving space, comprising a disk-like base, and an annular protrusion rising from the base and defining the projection-receiving space above the base, wherein the annular protrusion includes thick-walled portions with the thickness from the inner surface of the protrusion to the radially outer side being relatively thick and thin-walled portions with the thickness being thinner than that in the thick-walled portions, the thick-walled portions and the thin-walled portions being arranged alternately in the circumferential direction.

In the invention, since the thick-walled portions and the thin-walled portions are provided alternately in the circumferential direction in the annular protrusion defining the projection-receiving space to mate with and demate from the projection of a male snap button, the thickness of the annular protrusion from its inner surface toward radially outward side changes thickly to thinly alternately in the circumferential direction. Thereby, the flexibility, in the radial direction, of the annular protrusion becomes low in the thick-walled portions and high in the thin-walled portions. As a result, in the annular protrusion, the thick-walled portions are relatively hard to be elastically deformed and the thin-walled portions are relatively easy to be elastically deformed.

In the invention, as synthetic resin for making the female snap button, thermoplastic resin such as vinyl chloride resin, polyethylene, polypropylene and the like can be preferably cited, but not limited to.

In an embodiment of the invention, the annular protrusion includes an inner bulge bulging radially inward at a distal side part on the inner surface of the protrusion. When the projection of a male snap button is put in and taken out from the projection-receiving space, the inner bulge of the annular protrusion will engage with an outer bulge bulging radially outward at a distal side part of the projection, bringing the annular protrusion to be elastically displaced radially outward temporarily.

In the invention, the thin-walled portions are depressed radially inward in a circular arc shape between circumferentially adjacent two of the thick-walled portions. In this case, the thin-walled portions become radially thinner gradually from the thick-walled portions. Therefore, stress arising at boundaries between the thick-walled portions and the thin-walled portions during deforming the thin-walled portions would be relieved, making the annular protrusion resistant to damege etc.

In an embodiment of the invention, in the radially inner end of the inner bulge, parts corresponding to the thin-walled portions are slightly recessed radially outward rather than parts corresponding to the thick-walled portions. That is, in the radially inner end of the inner bulge, parts corresponding to the thin-walled portions are slightly recessed radially outward while parts corresponding to the thick-walled portions are relatively slightly swell radially inward. Such circumferentially alternate minute recesses and swells on the radially inner end of the inner bulge can help promote the difference in the flexibility between the thick-walled portions and the thin-walled portions.

In the invention, since the thick-walled portions and the thin-walled portions are provided alternately in the circumferential direction in the annular protrusion defining the projection-receiving space to mate with and demate from the projection of a male snap button, the flexibility of the annular protrusion changes alternately high to low in the circumferential direction. Therefore, high precision in terms of the flexibility of the annular protrusion is not required in producing the female snap, making the production easier. Further, a detachment resistance in the projection-receiving space relative to the projection can be maintained relatively high by the thick-walled portions as being low flexible, and a mating and demating force required to mate and demate the projection with and from the projection-receiving space can be reduced by the thin-walled portions as being high flexible. Furthermore, since the flexibility of the annular protrusion changes in the circumferential direction, it is unlikely to bring about nonuniformity in the detachment resistance or the mating and demating force in the circumferential direction.

DETAILED DESCRIPTION OF THE INVENTION

Figure 1:
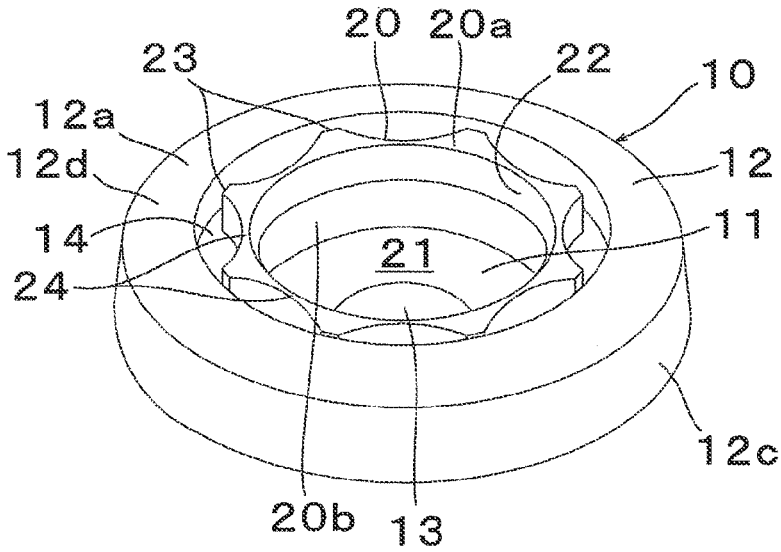
FIG. 1 is a perspective view of a female snap button in accordance with an embodiment of the invention.
Figure 2:
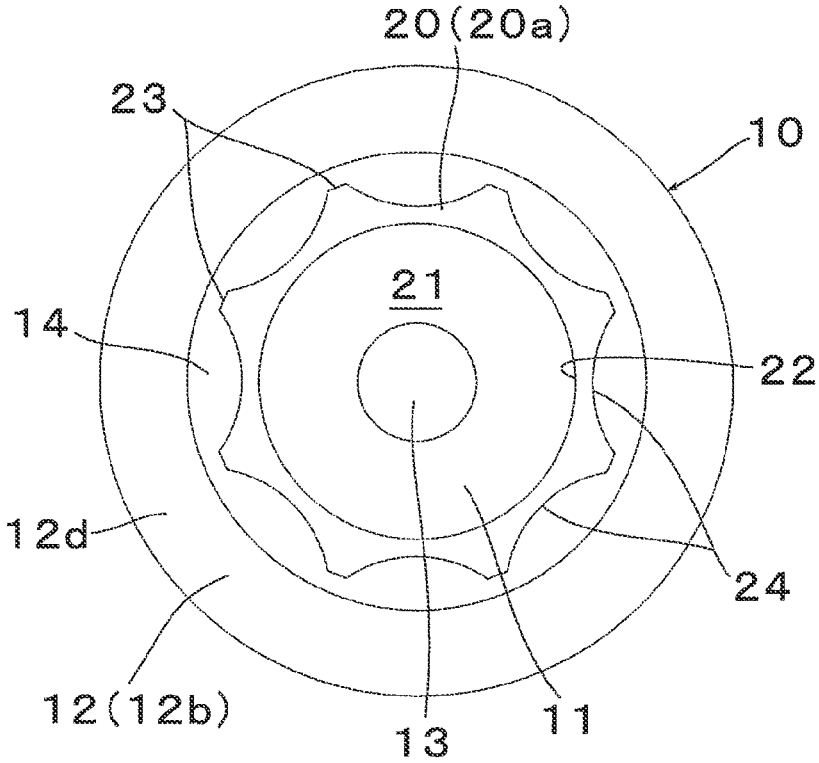
FIG. 2 is a plan view of the female snap button in FIG. 1.
Figure 3:
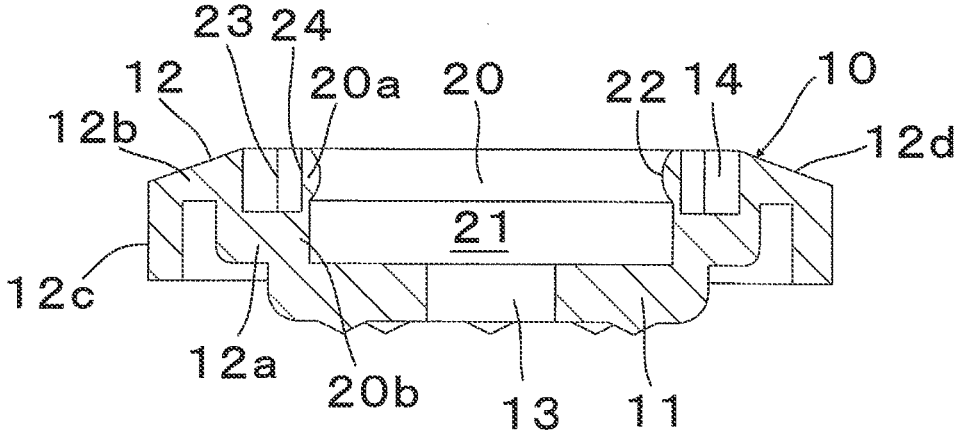
FIG. 3 is a longitudinal sectional view of the female snap button in FIG. 1.

Hereinafter, preferred embodiments of the present invention be described with reference to the drawings. FIGS. 1 to 3 are a perspective view, a plan (top) view and a longitudinal sectional view, respectively, of a female snap button (hereinafter referred to simply as "female snap") 10 in accordance with an embodiment of the invention. The female snap button 10 is injection-molded of thermoplastic resin and comprises a disk-like base 11, an annular protrusion 20 rising upward (up-and-down directions are based on FIG. 3) from a radially outer end of the base 11, and a flange 12 extending radially outward from a lower half portion 20*b* of the annular protrusion 20. In a center part of the base 11, there is formed a through-hole 13 to pass a post 32 of a button fastener 30 (see FIG. 4) through the hole when the female snap 10 become fastened to a cloth 1 (see FIG. 4). The annular protrusion 20 defines radially inward above the base 11 a projection-receiving space 21 for detachably receiving a projection 42 of a male snap button. (hereinafter referred to simply as "male snap") 40 (see FIG. 4). An upper half portion 20*a* of the annular protrusion 20 is formed to be relatively thin in thickness so as to be able to be elastically displaced radially outward when the projection 42 of the male snap 40 is put in and taken out from the projection-receiving space 21 as described later in detail. Hereinafter, the upper half portion 20*a* of the annular protrusion 20 is referred to as "annular upper portion 20*a*." On the inner peripheral surface of the annular upper portion 20*a*, there is provided an inner bulge 22 bulging radially inward in the whole circumferential direction. Although the inner peripheral surface of the inner bulge 22 is in a horizontally circle shape, it is possible to provide minute recesses 22*b* and minute swells 22*a* to the surface as described later. The lower half portion 20*b* of the annular protrusion 20 is radially thicker than the annular upper portion 20*a* and continuously extends radially outward to the flange 12. The flange 12 includes a flange proximal portion 12*a* expanding radially outward from the lower half portion 20*b* of the annular protrusion 20, a flange body 12*b* extending upward from a radially outer end of the flange proximal portion 12*a* and defining an annular flange upper surface 12*d* which inclines as decreasing in height radially outward, and a flange skirt 12*c* extending downward from a radially outer end of the flange body 12*b*. Between an inner face, facing radially inward, of the flange body 12*b* and an outer periphery, as described later in detail, of the annular upper portion 20*a*, there is an annular gap 14 being open upward. The height of the radially inner end of the flange upper surface 12*d* is the same as that of the top of the annular protrusion 20.

In the annular upper portion 20*a*, there are formed two or more (eight in this embodiment) thick-walled portions 23 having relatively thick thickness from the inner surface to the radially outer side and two or more (eight in this embodiment) thin-walled portions 24 having thinner thickness than that of the thick-walled portions 23, the thick-walled and thin-walled portions being arranged alternately in the circumferential direction. As an example, the thick-walled portions 23 project radially outward at 45 degree intervals in the circumferential direction, and the thin-walled portions 24 are depressed radially inward in a circular arc shape. Therefore, the flexibility, in the radial direction, of the annular upper portion 20*a* is low in the thick-walled portions 23 and high in the thin-walled portions 24. Since the radial thickness of each of the thin-walled portions 24, 74 is gradually decreasing away from the thick-walled portions 23, 73, when the projection 42 of the male snap 40 is put in and taken out from the projection-receiving space 21, it is unlikely to bring about a stress concentration at boundaries between the thick-walled portion 23, 73 and the thin-walled portion 24, 74, making the annular upper portion resistant to damage etc.

Figure 4:
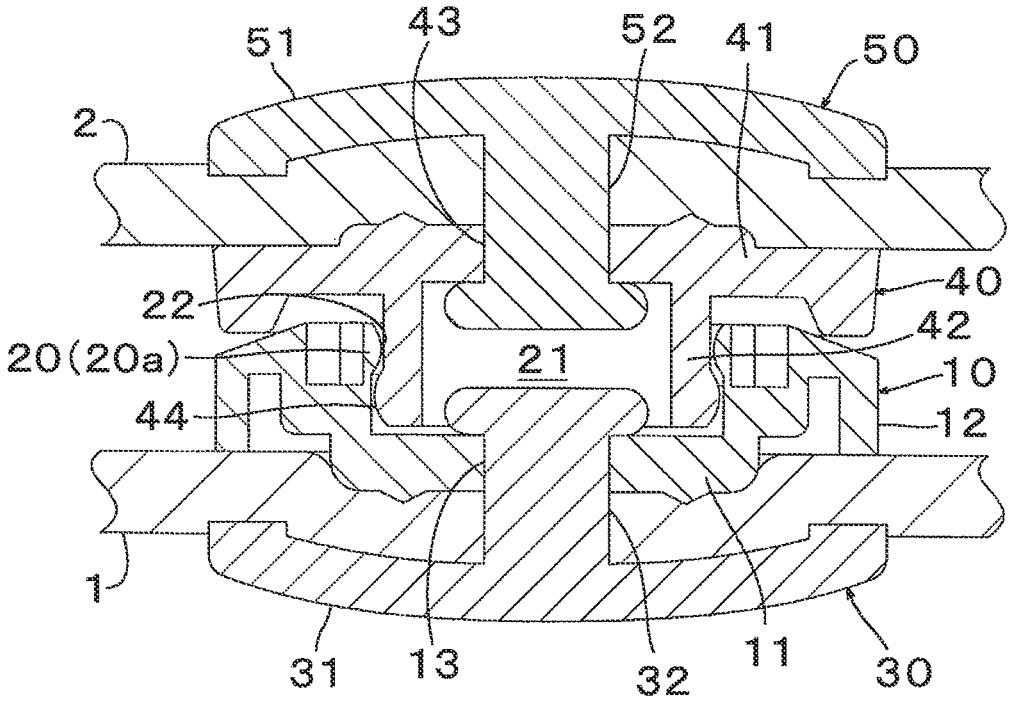
FIG. 4 is an illustrative longitudinal sectional view showing a state where the female snap and a male snap are connected with each other.

FIG. 4 shows an illustrative longitudinal sectional view of a state where the female snap 10 and the male snap 40 are connected with each other. The male snap 40 is injection-molded of thermareplastic resin and comprises a disk-like base 41 having a through-hole 43 in its center part, and a cylindrical projection 42 rising from the base 41. At a distal side part of the outer peripheral surface of the projection 42, there is formed an outer bulge 44 bulging radially outward. The female and male snaps 10, 40 have been fastened to cloths 1, 2 using button fasteners 30, 50, respectively. Each of the button fasteners 30, 50 comprises a disk-like base 31, 51 and a post 32, 52 rising from at a center part of the base 31, 51. The female and male snaps 10, 40 can be fixed onto the cloths 1, 2 by swaging the posts 32, 52 after the posts 32, 52 have just passed through the cloths 1, 2 and then the through-holes 13, 43 of the female and male snaps 10, 40.

When the male snap 40 is connected and disconnected with the female snap 40, the outer bulge 44 of the projection 42 of the male snap 40 overlaps the inner bulge 22 of the annular upper portion 20*a*, and then the outer bulge 44 passes the inner bulge 22. At the moment of the outer bulge 44 overlapping the inner bulge 22, the annular upper portion 20*a* is being elastically deformed radially outward, expanding the inner diameter of the annular upper portion 20*a*. Then, once the outer bulge 44 has gone over the inner bulge 22, the annular upper portion 20*a* is restored radially inward (There is a case that the outer bulge 44 is not restored to the initial state when the male and female snaps 40, 10 are connected with each other). Thereby, receiving the projection 42 in the projection-receiving space 21 (see FIG. 4) or removing the projection 42 from the space 21 is completed. Since the flexibility of the annular upper portion 20*a* of the female snap 10 is low in the thick-walled portions 23 and high in the thin-walled portions 24, a force (mating and demating force) required to mate and denate the projection 42 with and from the projection-receiving space 21 can be reduced because of the presence of the thin-walled portions 24 as being high flexible between the thick-walled portions 23. On the other hand, a detachment resistance to prevent the projection 24 from being easily removed from the projection-receiving space 21 can be maintained relatively high because of the presence of the thick-walled portions 23 as being low flexible.

Figure 5:
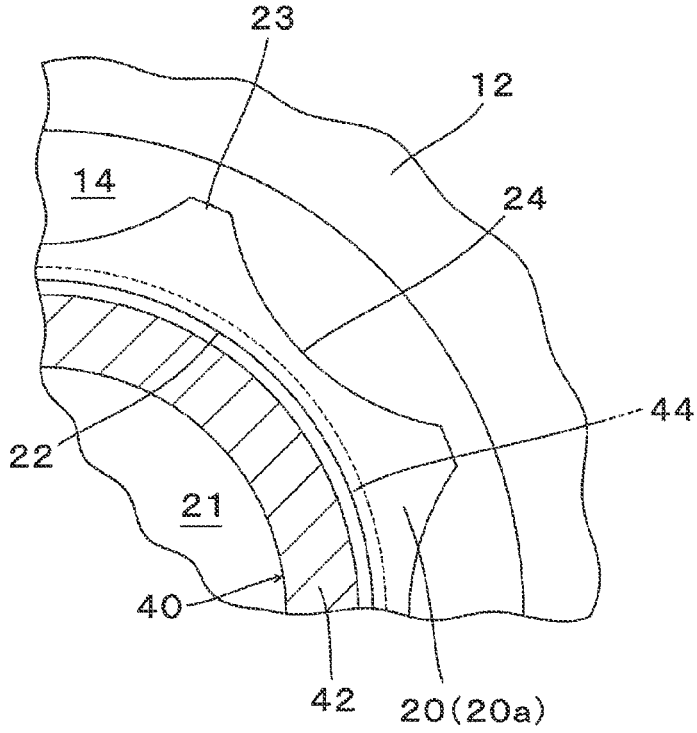
FIG. 5 is an enlarged cutaway view showing a degree of an outer bulge of a projection of the male snap catching on an inner bulge of an annular protrusion of the female snap button in the connected state in FIG. 4.

FIG. 5 is an enlarged cutaway view showing a state where the outer bulge 44 of the projection 42 is overlapping the inner bulge 22 of the annular upper portion 20*a* in the axial direction as the male and female snaps 40, 10 are connected with each other. In FIG. 5, the projection 42 except for the outer bulge 44 is indicated by a horizontal cross section, and the radially outer end of the outer bulge 44 which is hidden by the inner bulge 22 is shown by a broken line. In this way, the outer bulge 44 of the projection 42 catches on the inner bulge 22 of the annular upper portion 20*a*, which prevents the projection 42 from being easily removed from the projection-receiving space 21.

Figure 6:
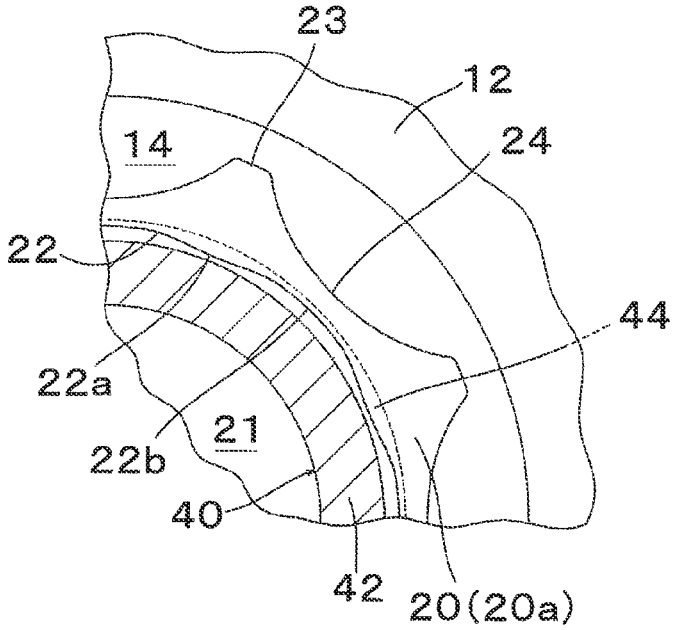
FIG. 6 is an enlarged cutaway view, similar to FIG. 5, showing an embodiment where there are minute recesses and minute swells in the inner bulge of the annular protrusion of the female snap button.

FIG. 6 is an enlarged cutaway view, similar to FIG. 5, showing an embodiment where, in the radially inner end of the inner bulge 22 of the annular upper portion 20*a*, parts corresponding to the thin-walled portions 24 are slightly recessed radially outward (as minute recesses 22*b*) and parts corresponding to the thick-walled portions 23 relatively slightly swell radially inward (as minute swells 22*a*). In FIG. 6, as the parts other than the minute recesses 22*h* and the minute swells 22*a* are the same as those in FIG. 5, the same reference numerals as in FIG. 5 are used. The minute recesses 22*b* and swells 22*a* are provided on the radially inner end of the inner bulge 22 alternately in the circumferential direction. The minute recesses 22*b* and swells 22*a* can be formed using a mold for injection-molding the female snap 10. In addition, the minute recesses 22*b* and swells 22*a* may be formed by utilizing a point that parts corresponding to the thin-wailed portions 24 of the inner bulge 22 of the annular upper portion 20*a* would contract more than parts corresponding to the thick-walled portions 23 during cooling period in the ordinary temperature after injection-atmosphereing the female snap 10. The minute swells 22*a* and recesses 22*b* in the inner bulge 22 can help promote the difference in the flexibility between the thick-walled portions 23 and the thin-walled portions 24.

Figure 7:
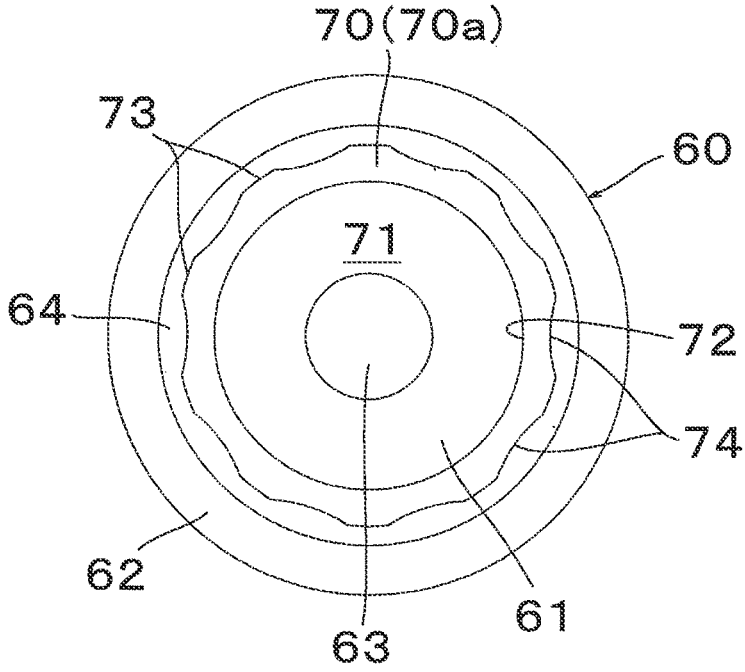
FIG. 7 is a plan view of a female snap button in accordance with another embodiment of the invention.
Figure 8:
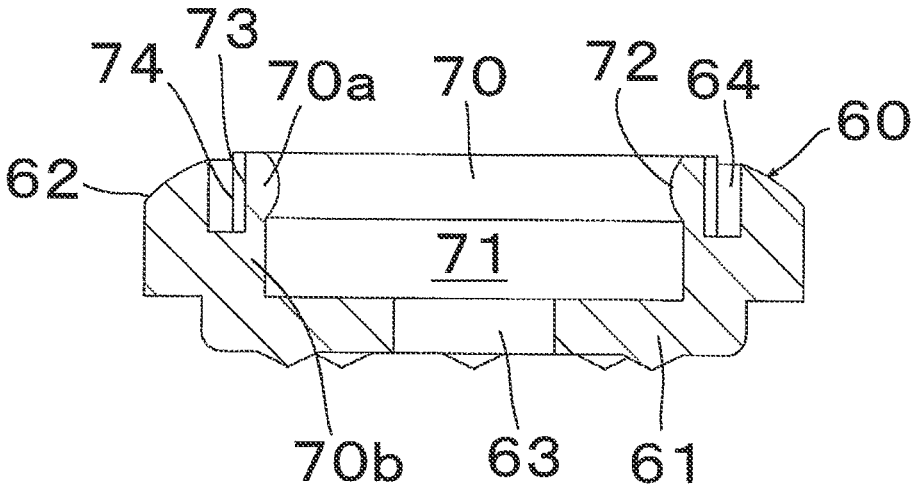
FIG. 8 is a longitudinal sectional view of the female snap button in FIG. 7.
Figure 9:
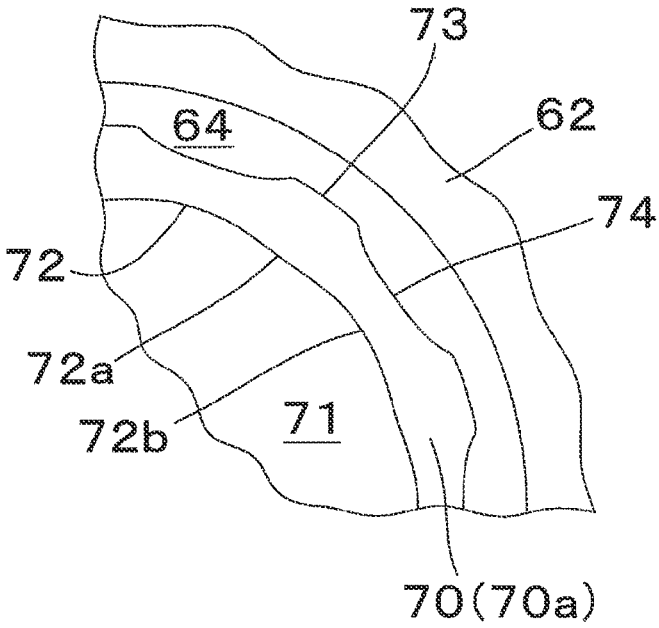
FIG. 9 is an enlarged cutaway view showing about the inner bulge of the female snap button in FIG. 7.

FIGS. 7 and 8 are a plan view and a longitudinal sectional view, respectively, of a female snap button 60 in accordance with another embodiment of the invention. The female snap 60 is injection-molded of thermoplastic resin and comprises a disk-like base 61, an annular protrusion 70 rising upward from a radially outer end of the base 61, and a flange 62 extending radially outward from a lower half portion 70*b* of the annular protrusion 70. In a center part of the base 61, there is formed a through-hole 63 to pass the post 32 of the button fastener 30 through the hole. The annular protrusion 70 defines radially inward a projection-receiving space 71 for detachably receiving a projection 42 of a male snap 40. On the inner peripheral surface of an upper half portion (annular upper portion) 70*a* of the annular protrusion 70, there is provided an inner bulge 72 bulging radially inward in the whole circumferential direction. Between the flange 62 and the annular upper portion) 70*a*, there is an annular gap 64 being open upward. In the annular upper portion 70*a*, there are formed ten thick-walled portions 73 having relatively thick thickness from the inner surface to the radially outer side and ten thin-walled portions 74 having thinner thickness than that of the thick-walled portions 73, the thick-walled and thin-walled. portions being arranged alternately in the circumferential direction. A radially projecting degree (thickness) of the thick-walled portions 73 from the inner surface of the annular upper portion 70*a* to the radially outer side is less than that of the thick-walled portions 23 of the female snap 10 as described above. The thin-walled portions 74 are depressed radially inward in a circular arc shape between circumferentially adjacent two of the thick-walled portions 73. The flexibility, in the radial direction, of the annular upper portion 70*a* is low in the thick-walled portions 73 and high in the thin-walled portions 74. However, the difference in the flexibility between the thick-walled portions 73 and the thin-walled portions 74 is less than that between the thick-walled portions 23 and the thin-walled portions 24 because the degree of radial projection and depression of the thick and thin-walled portions 73, 74 is less than that of the thick and thin-walled portions 23, 24 of the female snap 10 as described above. Although the inner peripheral surface of the inner bulge 72 of the annular upper portion 70*a* is in a horizontally circle shape, it is possible to provide minute recesses 72*b* and minute swells 72*a* to the surface as shown in FIG. 9. That is, in the radially inner end of the inner bulge 72, the minute recesses 72*b* being slightly recessed radially outward are formed at parts corresponding to the thin-walled portions 24 and the minute swells 22*a* relatively swelling radially inward are formed at parts corresponding to the thick-walled portions 73, if desired. In FIG. 9, as the parts other than the minute recesses 72*b* and the minute swells 72*a* are the same as those in FIGS. 7 and 8, the same reference numerals as in the Figs. are used. The degree of swell and recess of the minute swells 72*a* and recesses 72*b* is less than that of the minute swells 22*a* and recesses 22*b* of the female snap 10.

Figure 10:
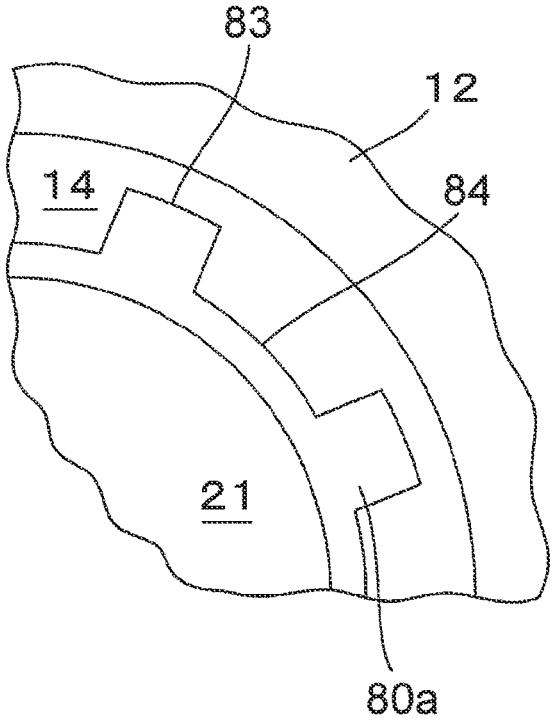
FIG. 10 is an illustrative cutaway view showing another example of thick-walled portions and thin-walled portions of the annular upper portion.

FIG. 10 is an illustrative cutaway view showing thick-walled portions 83 and thin-walled portions 84 of an annular upper portion 80*a* as another example in the female snap 10. In FIG. 10, since the parts other than the thick-walled portions 83 and the thin-walled portions 84 are the same as those of the female snap 10, the same reference numerals are used. The thick-walled portions 83 project radially outward in a rectangular shape, and the thin-walled portions 84 are depressed radially inward in a rectangular shape between circumferentially adjacent two of the thick-walled portions 83. Therefore, between the thick-walled portion 83 and the thin-walled portion 84, the transition is sudden with a stepped boundary. In this case, the thin-walled portions 84 have the advantage of being easily elastically displaced relative to the thick-walled portions 83 rather than the thin-walled portion 24, 74 with the circular arc radial depression as described above.

Figure 11:
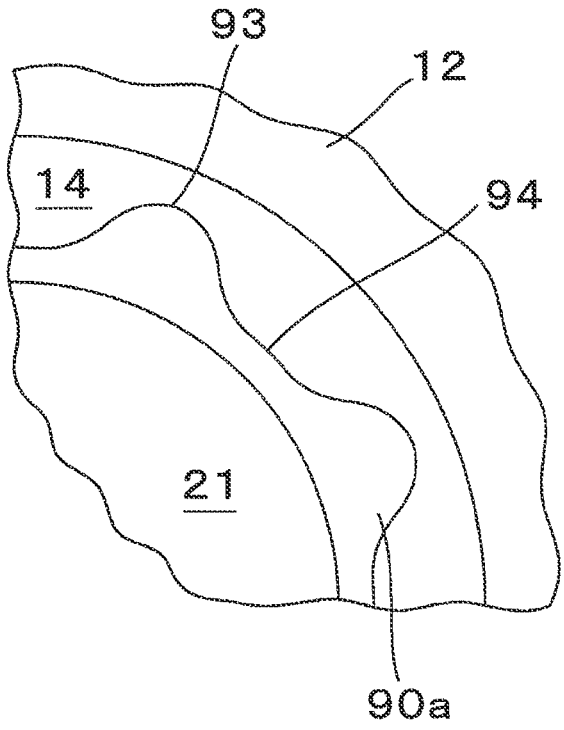
FIG. 11 is an illustrative cutaway view showing still another example of thick-walled portions and thin-walled portions of the annular upper portion.

FIG. 11 is an illustrative cutaway view showing thick-walled portions 93 and thin-walled, portions 94 of an annular upper portion 90*a* as still another example in the female snap 10. In FIG. 11, since the parts other than the thick-walled portions 93 and the thin-walled portions 94 are the same as those of the female snap 10, the same reference numerals are used. Between the thick-walled portion 93 and the thin-walled portion 94, the transition is less sudden than between the thick-walled portion 83 and the thin-walled portion 84 and more sudden than between the thick-walled portion 23, 73 and the thin-walled portion 24, 74. In this regard, the thick-walled portions 93 and the thin-walled portions 94 are an example between the former and the latter. The thick-walled portions 93 project radially outward in an almost circular arc shape, and the wall thickness is gently reducing from the radially most projecting point of the thick-walled portion 93 to the thin-walled portion 94. The radially most depressed part of the thin-walled portion 94 is circumferentially longer than that of the thin-walled portion 24, 74. In this case, the thin-walled portions 94 are easily elastically displaced rather than the thin-walled portions 24, 74, and a stress between the thick-walled portion 93 and the thin-walled portion 94 can be relieved rather than between the thick-walled portion 83 and the thin-walled portion 84.

DESCRIPTION OF REFERENCE NUMBERS

1, 2 cloth
10, 60 female snap button
11, 61 base
20, 70 annular protrusion
20*a*, 70*a*, 80*a*, 90*a* upper half portion (annular upper portion) of the annular protrusion
21, 71 projection-receiving space
22, 72 inner bulge
22*a*, 72*a* minute swell
22*b*, 72*b* minute recess
23, 73, 83, 93 thick-walled portion
24, 74, 84, 94 thin-walled portion
40 male snap button
42 projection
44 outer bulge

The invention claimed is:

1. A female snap button made of synthetic resin which detachably receives a projection of a male snap button in a projection-receiving space, comprising:

a disk-like base, and an annular protrusion rising from the base and defining the projection-receiving space above the base, wherein the annular protrusion includes thick-walled portions with the thickness from an inner surface of the protrusion to a radially outer side being relatively thick and thin-walled portions with the thickness being thinner than that in the thick-walled portions, the thick-walled portions and the thin-walled portions being arranged alternately in a circumferential direction, wherein the thin-walled portions are depressed radially inward between two circumferentially adjacent thick-walled portions.

2. The female snap button according to claim 1, wherein the annular protrusion includes an inner bulge bulging radially inward at a distal side part on the inner surface of the protrusion.

3. The female snap button according to claim 1, wherein the thin-walled portions are depressed radially inward in a circular arc shape between two circumferentially adjacent thick-walled portions.

4. The female snap button according to claim 2, wherein, in the radially inner end of the inner bulge, parts corresponding to the thin-walled portions are slightly recessed more radially outward than parts corresponding to the thick-walled portions.

5. The female snap button according to claim 2, wherein the thin-walled portions are depressed radially inward in a circular arc shape between two circumferentially adjacent thick-walled portions.

6. The female snap button according to claim 1, further comprising a flange extending radially outward from the annular protrusion, wherein there is an annular gap between the flange and the annular protrusion.

* * * * *

UNITED STATES PATENT AND TRADEMARK OFFICE

CERTIFICATE OF CORRECTION

PATENT NO. : 8,561,264 B2
APPLICATION NO. : 13/576733
DATED : October 22, 2013
INVENTOR(S) : Kenji Hasegawa et al.

It is certified that error appears in the above-identified patent and that said Letters Patent is hereby corrected as shown below:

In the Specification

In column 2, line 58, Delete “damege” and insert -- damage --, therefor.

In column 3, line 58, Delete “be described” and insert -- will be described --, therefor.

In column 4, line 61, Delete “thermareplastic” and insert -- thermoplastic --, therefor.

In column 5, line 26, Delete “denate” and insert -- demate --, therefor.

In column 5, line 58, Delete “22h” and insert -- 22b --, therefor.

Signed and Sealed this
Fourth Day of February, 2014

Michelle K. Lee

Michelle K. Lee
*Deputy Director of the United States Patent and Trademark Office*